United States Patent [19]

Oshima

[11] Patent Number: 4,715,209

[45] Date of Patent: Dec. 29, 1987

[54] CROWN CONTROL COMPENSATION CONTROLLING METHOD IN MULTIPLE ROLL MILL

[75] Inventor: Hiroo Oshima, Kobe, Japan

[73] Assignee: Kabushiki Kaisha Kobe Seiko Sho, Kobe, Japan

[21] Appl. No.: 825,981

[22] Filed: Feb. 4, 1986

[30] Foreign Application Priority Data

Jun. 6, 1985 [JP] Japan ..... 60-124000

[51] Int. Cl.[4] ..... B21B 37/12

[52] U.S. Cl. ..... 72/366; 72/8; 72/11; 72/16; 72/20; 72/244; 72/245

[58] Field of Search ..... 72/16, 20, 8, 9–12, 72/243, 244, 245, 365, 366

[56] References Cited

U.S. PATENT DOCUMENTS 3,620,058 11/1971 Sabatini et al. ..... 72/16 X 3,709,010 1/1973 Tatsumi ..... 72/20 X 3,855,830 12/1974 Kitanosono et al. ..... 72/16 X 3,875,775 4/1975 Daniljuk et al. ..... 72/20 X 4,458,515 7/1984 Imai ..... 72/20

4,577,480 3/1986 Kizaki et al. ..... 72/20 X

*Primary Examiner*—Lowell A. Larson

*Assistant Examiner*—Steve Katz

*Attorney, Agent, or Firm*—Oblon, Fisher, Spivak, McClelland & Maier

[57] ABSTRACT

A crown control compensation controlling method in a multiple roll mill, in which a variation of rolling load caused by crown control is obtained from a crown control quantity. A wedge type hydraulic reduction device is operated according to the variation of rolling load to thereby cancel such rolling load variation. Both an automatic gauge control (AGC) and an automatic shape control (AFC) can be attained while preventing a change in plate thickness caused by crown control.

1 Claim, 2 Drawing Figures

CROWN CONTROL COMPENSATION CONTROLLING METHOD IN MULTIPLE ROLL MILL

BACKGROUND OF THE INVENTION

1. Field of the Invention

The present invention relates to a crown control compensation controlling method capable of automatically compensating for variations in plate thickness caused by crown control and effecting a stable control in a multiple roll mill for rolling thin plates such as nonferrous metals and special steels.

2. Description of the Prior Art

As an actuator for controlling the shape of a rolling stock being rolled by a multiple roll mill there is a crown control device. It is known that, if this device is operated, there will arise a change in roll gap, which causes a variation in plate thickness.

Therefore, where such crown control device is operated to control the shape of a rolling stock, it is necessary to perform operations gradually in consideration of a response from a thickness gauge so as not to exert a bad influence on the plate thickness.

On the other hand, a wedge type hydraulic reduction device has been applied to a multiple roll mill. This device makes a high-speed control for roll gap and effects an automatic plate thickness control as disclosed in Japanese Patent Laid-Open Publication No. 9707/83. For this automatic plate thickness controller there is adopted a constant gap control or a feed forward control to obtain products with a high accuracy of plate thickness.

According to the prior art, however, variations in plate thickness caused by crown control are corrected only by feedback of a thickness gauge monitor, so during the period corresponding to the delay time of the feedback, the plate thickness becomes off-gauge, thus making it impossible to effect a high-speed control for obtaining a rolled product which is satisfactory in both shape and thickness.

SUMMARY OF THE INVENTION

According to the present invention, which has been accomplished in view of the above problem, there is provided a crown control compensation controlling method in a multiple roll mill capable of cancelling a variation in plate thickness caused by crown automatically and real-timewise to realize both a high-speed AGC (automatic gauge control) and a high-speed AFC (automatic flatness control) at the same time. Accordingly, the subject method produces a product having a high accuracy of thickness and a good shape.

In order to achieve the above-mentioned object, the crown control compensation controlling method in a multiple roll mill of the present invention is characterized in that a variation in rolling load caused by crown control is determined from a crown control quantity, and a wedge type hydraulic reduction device is operated according to such variation in rolling load to thereby cancel the rolling load variation. By combining this controlling method with a constant gap control, an automatic flatness control (AFC) and an automatic gauge control (AGC) for rolling stocks are both obtained, thereby realizing a so-called AFGC system.

BRIEF DESCRIPTION OF THE DRAWINGS

The drawings illustrate an embodiment of the present invention, in which.

DESCRIPTION OF A PREFERRED EMBODIMENT

An embodiment of the present invention will be described hereinunder with reference to the drawings.

Figure 2:
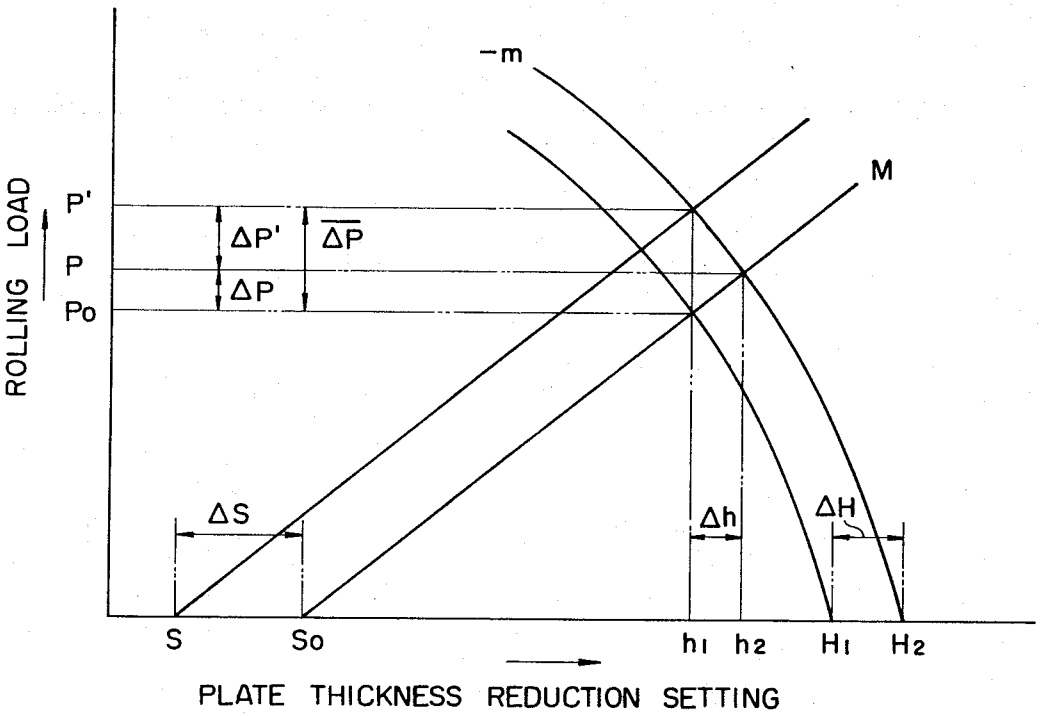
FIG. 2 is a rolling characteristic diagram for explanation of the principle of the present invention.

Referring first to FIG. 2, there is illustrated the principle of a constant gap control in which a rolling load which varies depending on a variation in plate thickness on an incoming side is detected, and the roll gap is corrected by a hydraulic reduction device in accordance with the detected signal.

It is here assumed that, when a rolling stock having a plate thickness $H_1$ on the incoming side is rolled at the initial roll gap $S_0$, the plate thickness on an outgoing side is $h_1$ and the rolling force is $P_0$.

When the plate thickness on the incoming side becomes $H_2$, the plate thickness on the outgoing side becomes $h_2$ if there is no control. At the same time, the rolling load changes by $\Delta P$ from $P_0$ to P.

Between the rolling load variation $\Delta P$ and the plate thickness variation $\Delta h$, for the plate thickness variation $\Delta H$ on the incoming side, there exists the following relationship if the mill modulus of the rolling mill is M and the plasticity modulus of the rolling stock is m:

$$\Delta P = M \cdot \Delta h \tag{1}$$

If the rolling load variation $\Delta P$ is detected by a rolling load meter and the roll gap is shifted to S (that is, if it is reduced by $\Delta S$) on the basis of the $\Delta P$, the plate thickness on the outgoing side returns to the original $h_1$ and the plate thickness variation $\Delta h$ on the outgoing side becomes zero.

Therefore, if a load variation induced by a change of reduction setting is $\Delta P'$, $$\Delta P' = m \cdot \Delta h \tag{2}$$

$$\overline{\Delta P} = \Delta P + \Delta P' = -M \cdot \Delta S \tag{3}$$

wherein $\overline{\Delta P}$ represents the load variation detected by a load cell. The reason why a negative mark is affixed thereto in the above equation (3) is that the relation between increase/decrease of the roll gap caused by operation of the control system and increase/decrease of load is an inverse correlation.

If $\Delta P'$ and $\Delta h$ are cancelled from the above equations (1), (2) and (3), $$\left(1 + \frac{m}{M}\right) \cdot \Delta P = -M \cdot \Delta S \tag{4}$$

$$\therefore \Delta S = -\frac{M + m}{M^2} \cdot \Delta P$$

However, since it is impossible for the rolling load cell to detect only the load variation $\Delta P$ caused by a change in characteristic of the rolling stock on the incoming side and disregard the load variation $\Delta P'$ induced by a change of the reduction setting, the load cell always detects $\overline{\Delta P}$. Therefore, a direct use of the equation (4) in the control is impossible.

That is, if control is made in accordance with the equation (4), $$\Delta S \rightarrow -\frac{M+m}{M^2}\cdot\overline{\Delta P}$$

$$= -\frac{M+m}{M^2}\cdot(\Delta P+\Delta P')$$

Thus, an excess control results.

To prevent this excess control, it is necessary to draw out only the load variation $\Delta P$. Therefore, it is necessary to predict the load variation $\Delta P'$ induced by a change of reduction setting.

If the load variation $\Delta P$ and the variation of plate thickness $\Delta h$ on the outgoing side are cancelled from the equations (1), (2) and (3), $$\frac{\Delta P'}{\Delta S} = -\frac{Mm}{M+m} \quad (5)$$

The left side of the equation (5) represents a rate of change in rolling load induced when the reduction setting is varied manually. Thus, by giving a certain amount of variation in reduction setting manually for a very short time, for example at the beginning of rolling, and actually measuring a rolling load variation at that time, there can be obtained $$\frac{Mm}{M+m}$$

as a measured value.

If this measured value is $K_2$, the equation (4) can be written as follows:

$$\Delta S = -\frac{M+m}{M^2}\cdot(\overline{\Delta P}+K_2\cdot\Delta S) \quad (6)$$

Thus, an optimum control is effected by dynamically offsetting the excess control based on the load variation $\Delta P'$ induced by the roll gap variation $\Delta S$ while performing a reduction control for the $\Delta S$.

The crown control compensation controlling method in a multiple roll mill according to this embodiment of the invention will now be described on the basis of the above constant gap control method and with reference to FIG. 1.

The thick line portion in the figure represents a crown control compensation controller section.

If the number of crown control points is n, then the coefficient of influence of the crown control quantity at each point upon the rolling load can be obtained by an actual measurement at every rolling pass. Influence coefficients at those control points are assumed to be $L_1, L_2, \ldots L_n$.

Further, if the rolling load variation when crown control is made without changing the other conditions at all is $\Delta P''$, and if the crown control quantities at the control points are $\Delta C_1, \Delta C_2, \ldots \Delta C_n$, $$\Delta P'' = \sum_{i=1}^{n} Li\,\Delta Ci$$

The rolling load variation $\Delta P'$ caused by the roll gap control with a reduction wedge is as follows from the equation (5):

$$\Delta P' = -\frac{Mm}{M+m}\cdot\Delta S$$

The rolling load variation $\Delta P''$ induced when crown control is made under control of the reduction wedge can be cancelled and eliminated by effecting the following control automatically:

$$\Delta P''+\Delta P'\rightarrow 0$$

Thus, the reduction wedge should be controlled so that the roll gap control quantity $\Delta S$ becomes as follows:

$$\Delta S = \frac{M+m}{Mm}\cdot\sum_{i=1}^{n} Li\,\Delta Ci \quad (7)$$

The following description is now provided about the combination of this crown control compensation controlling method with the constant gap control. It goes without saying that the combination with a feed forward control can also be made in the same manner.

As referred to in the equation (4), the following is a basic equation of the constant gap control:

$$\Delta S = -\frac{M+m}{M^2}\cdot\Delta P \quad (8)$$

Under the compensation control for crown control, $$\overline{\Delta P}=\Delta P+\Delta P'+\Delta P''$$

If the load variation $\Delta P'$ induced by a change of reduction setting is divided into a portion $\Delta P_1'$ of the constant gap control and a portion $\Delta P_2'$ of the crown control compensation control in the present invention, $$\overline{\Delta P}=\Delta P+\Delta P_1'+\Delta P_2'+\Delta P''$$

Since $\Delta P''+\Delta P_2'\rightarrow 0$ under application of the crown control compensation control, $$\overline{\Delta P}=\Delta P+\Delta P_1'$$

Therefore, from the equation (8), the basic equation of the constant gap control becomes as follows:

$$\Delta S = -\frac{M+m}{M^2}(\overline{\Delta P}-\Delta P_1')$$

If the roll gap control quantity $\Delta S$ is divided into a portion $\Delta S_1$ of the constant gap control and a portion $\Delta S_2$ of the crown control compensation control, $$\Delta S=\Delta S_1+\Delta S_2 \quad (9)$$

From the equation (5), $$\Delta P_1' = -\frac{Mm}{M+m} \cdot \Delta S_1 \quad (10)$$

From the equation (7), $$\Delta S_2 = \frac{M+m}{Mm} \cdot \sum_{i=1}^{n} Li \cdot \Delta Ci \quad (11)$$

And from the equations (9), (10) and (11), $$\Delta P_1' = -\frac{Mm}{M+m}\left\{\Delta S - \frac{M+m}{Mm} \cdot \sum_{i=1}^{n} Li \cdot \Delta Ci\right\}$$

Thus, the basic equation of the constant gap control becomes as follows:

$$\Delta S = -\frac{M+m}{M^2}\left\{\overline{\Delta P} + \frac{Mm}{M+m} \cdot \Delta S - \sum_{i=1}^{n} Li \cdot \Delta Ci\right\} \quad (12)$$

Figure 1:
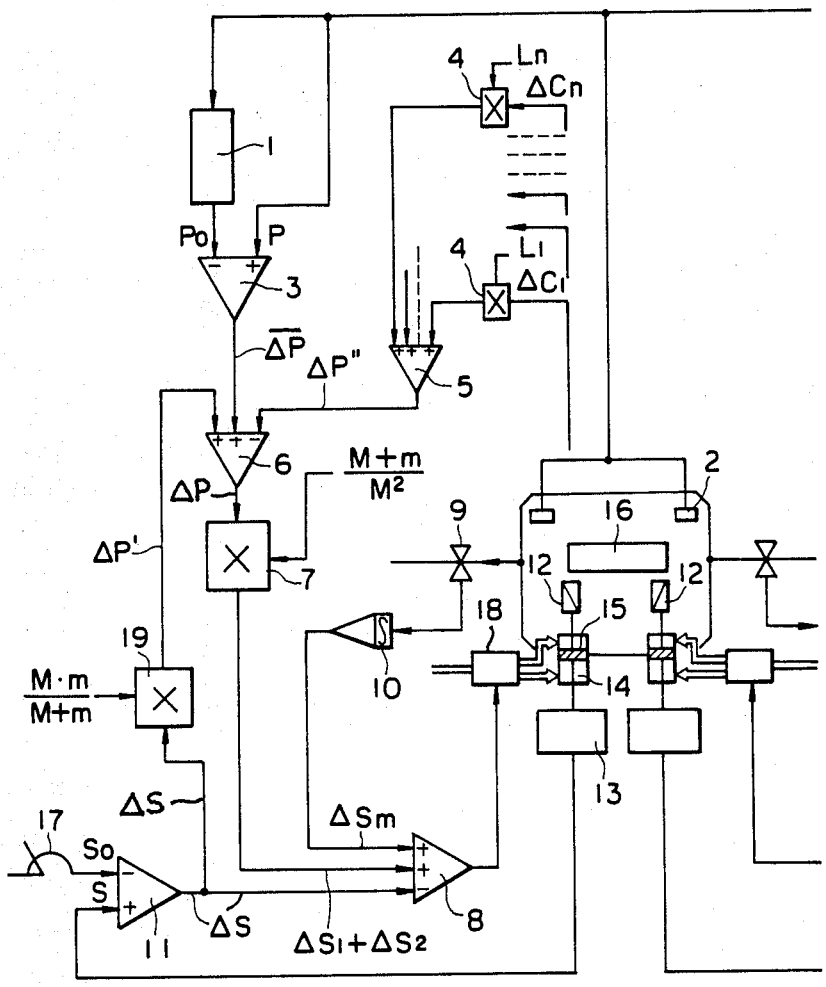
FIG. 1 is a block diagram showing a concrete construction of the present invention combined with a constant gap control.

FIG. 1 illustrates an automaic roll gap control device for implementing the above method.

In FIG. 1, the numeral 1 denotes a memory for storing an initial value (set rolling load) $P_0$ of a rolling load P detected by a rolling load detector 2, and the numeral 3 denotes an addition point which detects a deviation of the rolling load P actually measured from the set rolling load $P_0$ provided from the memory 1, namely, a rolling load variation $\overline{\Delta P}$. Numeral 4 denotes a multiplier for multiplying the crown control quantities $\Delta C_1, \Delta C_2, \ldots \Delta C_n$ at the control points by the coefficients of influence on rolling load, $L_1, L_2, \ldots L_n$, to calculate a rolling load variation $\Delta P$; numeral 5 denotes an addition point of those calculated values, which outputs a rolling load variation $\Delta P''$ under crown control to an addition point 6.

The addition point 6 makes subtraction for the rolling load variation $\Delta P''$ detected under crown control and at the same time makes addition for the above rolling load variation $\overline{\Delta P}$ and a secondary rolling load variation $\Delta P'$ which is provided from a later-described multiplier 19, then taking out only the rolling load variation $\Delta P$.

Numeral 7 denotes a multiplier for muliplying the rolling load variation $\Delta P$ by the value $$\frac{M+m}{M^2},$$

and numeral 8 denotes an addition point which adds (1) a monitor component $\Delta Sm$ based on feedback of a plate thickness deviation produced from an integrator 10 connected to a thickness guage monitor 9 and (2) the roll gap control quantity $\Delta S = \Delta S_1 + \Delta S_2$ including the crown control compensation control from the multiplier 7, and subtracts (3) the roll gap variation $\Delta S$ provided from an addition point 11.

To the addition point 11 which outputs the roll gap variation $\Delta S$ is added a shift position S in accordance with the pulse signal corresponding to a vertical displacement of a piston 15 of a wedge actuating cylinder 14 which is provided from a magnescale 13 serving as a position detector for a wedge 12 namely, the change of the roll gap between the upper and lower work rolls (not shown) of a mill body 16. Further, an initial roll gap $S_0$ from a setting unit 17 for setting a neutral position of the roll gap is subtracted from the shift position S in the addition point 11.

Numeral 18 denotes a hydraulic servo valve which is controlled in accordance with the output of the addition point 8. The wedge actuating cylinder 14 is driven by oil pressure supplied through the servo valve 18, thereby actuating the wedge 12 to increase or decrease the initial roll gap $S_0$.

Numeral 19 denotes a multiplier for multiplying the roll gap variation $\Delta S$ from the addition point 11 by the influence coefficient $$\frac{Mm}{M+m}$$

provided from a calculation means. The result of this multiplication is inputed to the addition point 6.

Under the above construction, when the incoming-side plate thickness $H_1$ undergoes a change of $\Delta H$, there is provided the rolling load variation $\overline{\Delta P}$ from the addition point 3. This rolling load variation $\overline{\Delta P}$ and $$\left(\frac{Mm}{M+m}\right) \cdot$$

$\Delta S$ provided from the multiplier 19 (namely, the rolling load variation $\Delta P'$) are added to the addition point 6, while the rolling load variation $\Delta P''$ detected under crown control is subtracted. Further, the rolling load variation $\Delta P$ taken out from the addition point 6 is multiplied by the value $$\frac{M+m}{M^2}$$

at the multiplier 7, and the result is output to the addition point 8.

At the addition point 8, the monitor component $\Delta Sm$ which is provided from the thickness gauge monitor 9 side, the constant gap control component $\Delta S_1 + \Delta S_2$ provided from the multiplier 7, and the roll gap variation $\Delta S$ provided from the addition point 11 are added, and a signal corresponding to the roll gap shown in the equation (12) is fed to the servo valve 18 to cause the wedge actuating cylinder 14 to operate so that the plate thickness on the outgoing side is kept constant even when the incoming-side plate thickness changes, with such roll gap correction quantity as a target.

Thus, according to the crown control compensation controlling method in a multiple roll mill of the present invention, the variation of rolling load caused by crown control is obtained from a crown control quantity, and a wedge type hydraulic reduction device is operated according to such rolling load variation to thereby cancel the rolling load variation. Consequently, an automatic gauge control and an automatic flatness control can be effected simultaneously while preventing a plate thickness variation caused by crown control, thus permitting automation of a multiple roll mill as well as improvement of the plate thickness accuracy and shape quality of rolled products.

What is claimed is:

1. A crown control compensation controlling method for controlling the position of at least one wedge in a multiple roll mill, said method comprising the steps of:

(a) detecting and storing an initial value $P_0$ of a rolling load;

(b) detecting the instantaneous value P of the rolling load;

(c) calculating the instantaneous rolling load variation $\overline{\Delta P}$ by subtracting the initial value $P_0$ of the rolling load from the instantaneous value P of the rolling;

(d) multiplying the crown control quantities $\Delta C_1$, $\Delta C_2$, . . . $\Delta C_n$ at preselected control points by the coefficients of influence on rolling load $L_1$, $L_2$, . . . $L_n$ and summing the products to obtain a rolling load variation $\Delta P''$;

(e) multiplying the instantaneous rolling load variation $\Delta P$ by the value $$\frac{M+m}{M^2}$$

wherein M is the mill modulus of the rolling mill and m is the plasticity modulus of the rolling stock, thereby obtaining a value $\Delta S_1+\Delta S_2=\Delta S$, wherein $\Delta S$ is the roll gap control quantity and $\Delta S_1$ and $\Delta S_2$ are two portions into which the roll gap control quantity $\Delta S$ is divided;

(f) multiplying the roll gap control variation $\Delta S$ by an influence coefficient $$\frac{Mm}{M+m},$$

wherein M and m are as defined previously to obtain the secondary rolling load variation $\Delta P'$;

(g) adding the instantaneous rolling load variation $\overline{\Delta P}$ and a secondary rolling load variation $\Delta P'$ and subtracting the rolling load variation $\Delta P''$ to obtain the instantaneous rolling load variation caused by entry plate thickness variation $\Delta P$;

(h) measuring the instantaneous plate thickness;

(i) calculating the plate thickness variation $\Delta P$;

(j) calculating a monitor component $\Delta S_m$ based on feedback of the plate thickness deviation;

(k) subtracting the initial roll gap $S_0$ between the upper and lower work rolls from the shift position S of the work rolls to obtain the roll gap variation $\Delta S$;

(l) adding the monitor component $\Delta S_m$ to the roll gap control quantity $\Delta S=\Delta S_1+\Delta S_2$ and subtracting the roll gap variation $\Delta S$; and (m) controlling the position of at least one wedge in accordance with the value of the roll gap control quantity $\Delta S=\Delta S_1+\Delta S_2$.

* * * * *